United States Patent [19]

Stiles

[11] Patent Number: 4,537,035

[45] Date of Patent: Aug. 27, 1985

[54] AIR CONDITIONING SYSTEM

[76] Inventor: Jack L. Stiles, 3912 E. Acapulco, Irving, Tex. 75062

[21] Appl. No.: 607,185

[22] Filed: May 4, 1984

[51] Int. Cl.[3] ..... F25B 29/00; F25D 17/04

[52] U.S. Cl. ..... 62/89; 62/186; 165/16; 236/49

[58] Field of Search ..... 165/16; 236/49; 62/186, 62/409, 89; 55/478, 480

[56] References Cited

U.S. PATENT DOCUMENTS

| | | | |
|---|---|---|---|
| 2,987,984 | 6/1961 | Miller | 98/94 AC |
| 3,363,531 | 1/1968 | Kohlmeyer et al. | 98/33 R |
| 3,841,398 | 10/1974 | Serratto | 165/16 X |
| 4,079,665 | 3/1978 | Martin | 98/33 R |
| 4,092,136 | 5/1978 | Zimbardi | 55/480 X |
| 4,347,712 | 9/1982 | Benton et al. | 236/49 X |

*Primary Examiner*—William E. Wayner

[57] ABSTRACT

A valve is provided that controls the type of air reaching an air conditioning blower. For example, in one position of the valve, returned, air conditioned air is continually recirculated to the blower without the addition of any fresh air. In another position of the valve the recirculated air is prevented from reaching the blower and only fresh air can flow to the air conditioner blower. The valve can also be located in an infinite number of positions wherein various mixtures of fresh and recirculated air are directed to the air conditioning blower. The valve is positioned by a motor which is in turn controlled by a sensor. The valve mechanism is mounted in a housing which may be included as a part of an original air conditioning system or may be attached to an existing system as a retrofit.

7 Claims, 4 Drawing Figures

AIR CONDITIONING SYSTEM

BACKGROUND OF THE INVENTION

This invention relates generally to improved air conditioning systems. More particularly, but not by way of limitation, this invention relates to an improved air conditioning system including means for controlling the air flow to the air conditioner blower.

In air conditioning systems, it is at times desirable to recirculate air from the system into the space to be cooled and back to the system over and over without adding any significant amount of outside or fresh air thereto. At other times, it is desirable to provide only fresh air into the system, and, at other times, it is desirable to be able to provide a mixture of recirculated air and fresh air.

Air conditioning systems previously constructed have, in window air conditioning units and automotive air conditioning systems, provided a manual control that could be utilized to provide air to the blower as described above. Such controls are not provided on remote air conditioning systems such as are used in buildings and the like where the air conditioning unit is not readily accessible to the user.

It is, therefore, an object of this invention to provide an air conditioning system or an attachment for air conditioning systems that includes a valve responsive to a sensed condition for providing fresh air, return air, or a mixture thereof to the air conditioning blower.

SUMMARY OF THE INVENTION

This invention then provides, for air conditioners, an improved system including a control valve that is pivotal from a first position wherein fresh air is in communication with the blower to a second position wherein return air is in communication with the blower and through an infinite number of intermediate positions where the fresh air and return air are mixed before reaching the blower. Also provided is a control means for varying the position of the control valve in response to a signal that is related to a desired condition.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
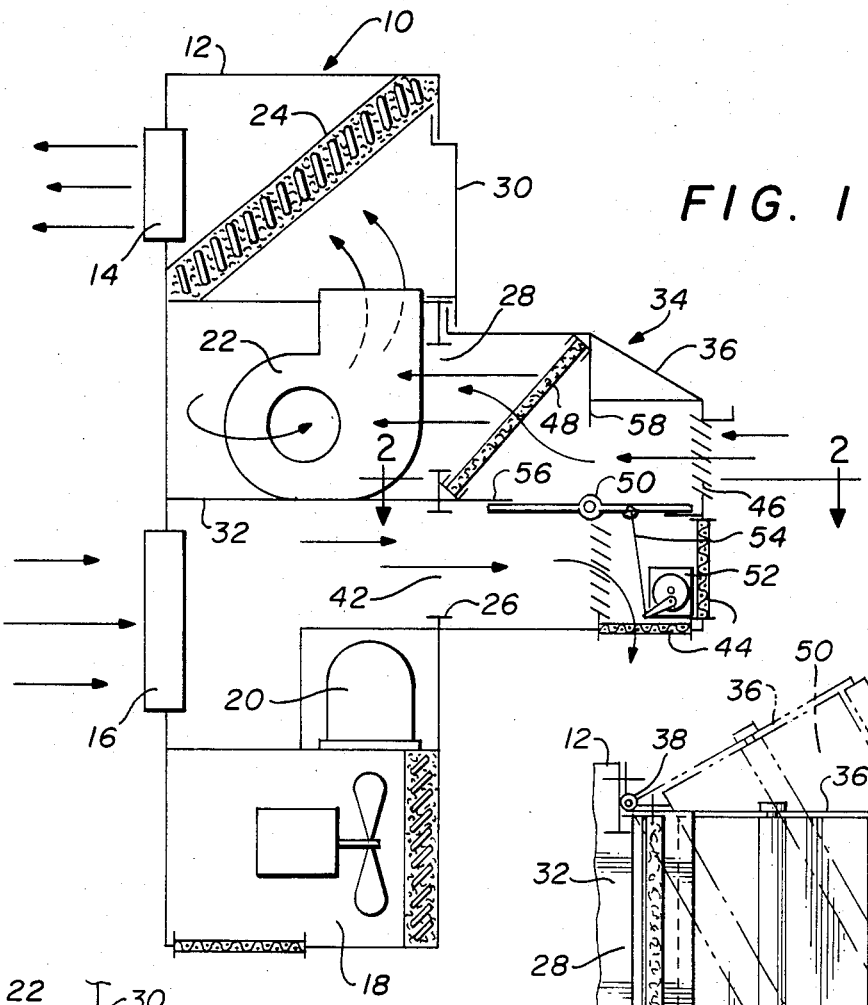
FIG. 1 is a vertical, cross-sectional view of an air conditioning system constructed in accordance with the invention.

Referring to the drawing and to FIG. 1 in particular, shown therein and generally designated by the reference character 10 is a thin-line air conditioning system that includes a housing 12 having an outlet 14 for delivering conditioned air into a space, such as a room or house (not shown). A return 16 is located in the housing whereby conditioned air is returned to the system 10. The air conditioning system 10 includes a condensing unit 18, a compresser 20, blower 22 and an evaporation coil 24. Although not shown, the compressor 20, condensing unit 18 and evaporation coils 24 are appropriately connected in a manner well known in the air conditioning art.

In previously constructed air conditioning systems of the thin-line type, the openings indicated at 26, 28 and 30 would normally be closed by an access panel 31 (shown by dash line) that would be removed only for the purpose of performing maintenance on the system. Also, in previously constructed units the return 16 would be connected directly to the blower 22 through opening 33 and the panel 32 would be omitted with a return air filter normally located at that position.

Attached to the housing 12 of the system 10 is an economizer 34. The economizer 34 includes a housing 36 pivotally mounted on the housing 12 by a hinge 38 (see FIG. 2) that is preferably of the continuous or piano type. The opposite edge of the housing 36 is secured to the housing 10 by a plurality of releasable threaded fasteners 40.

The housing 36 includes an opening 42 for receiving the return air, a return air outlet or exhaust opening 44 and a fresh air inlet 46. A filter 48 is removably located in the housing 36 and access thereto for purposes of changing the filter 48 can be easily had when the housing 36 is pivoted as shown in the dashed lines of FIG. 2.

Pivotally mounted within the housing 36 is a control valve 50 which is similar to a butterfly valve. The position of the valve 50 is controlled by a motor 52 and a linkage 54 which extends between the motor 52 and the valve 50. As illustrated in FIG. 1, the valve 50 is in a position preventing return air from reaching the blower 22 while permitting air flowing through the fresh air inlet 46 to reach the blower 22. Valve stops 56 and 58 are located in the housing 36 for limiting the travel of the valve 50.

The motor 52 is linked through a controller 60 with a sensing device 62. The sensing device 62 is exemplary only and several may be utilized if desired. The purpose of the sensor is to sense one or several functions that are related to the desired position of the valve 50 and, thus, to the mixture of fresh and return air. For example, the sensor 62 may sense outside temperature so that when the temperature of the outside air exceeds the desired inside temperature, the valve 50 will move to a position preventing entrance of fresh air into the unit. The sensing device 62 may sense humidity so that fresh air will be prevented from entering the system in the event that the outside air is extremely humid. Other functions, of course, can be utilized as desured.

OPERATION OF THE PREFERRED EMBODIMENT

With the air conditioning system 10 in operation, conditioned air is delivered by the blower 22 through the evaporater coils 24 and outwardly through the air conditioning outlet 14. Return air passes through the return 16, through the return air opening 42 in the economizer 36 and outwardly through the exhaust openings 44. As illustrated, and as previously, mentioned the valve 50 is in the position perventing the return air from re-entering the blower 22. Fresh air is being brought into the system through the fresh air opening 46, through the filter 48 and, thus, into the blower 22. Such a condition would probably be utilized when the outside air temperature, as sensed by the sensing device 62, is at a temperature or below the desired inside temperature.

Figure 4:
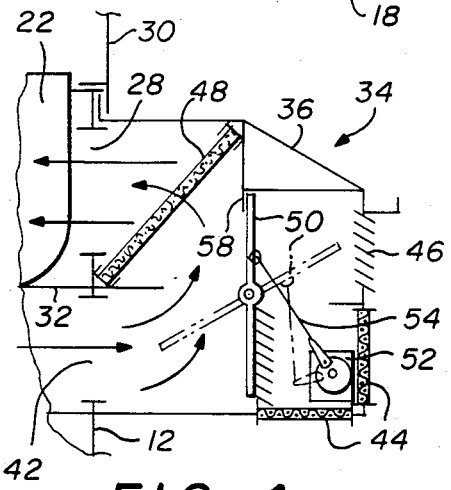
FIG. 4 is an enlarged partial cross-sectional view of the apparatus of FIG. 1, but illustrating the control valve in other operating positions.
Figure 3:
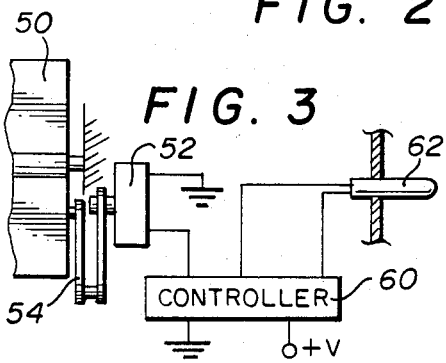
FIG. 3 is a schematic diagram illustrating the control circuit.

As the outside temperature approaches the desired inside temperature, the sensing device sends a signal to the controller 60 so that the controller 60 causes the motor 52, through the linkage 54, to re-position valve 50 to some intermediate position such as illustrated in dashed lines in FIG. 4. With the valve 50 in this position, the return air passing through the opening 42 is mixed with fresh air entering through the fresh air opening 46 prior to passing through the filter 48 and entering the blower 22 through the opening 28.

If the sensing device 62 indicates that the outside temperature is higher than the desired air conditioning temperature, and the system is so programmed, the controller 60 causes the motor 52 to re-position the valve 50 against the stop 58 as illustrated in solid lines in FIG. 4. In this position, the valve 50 prevents fresh air from entering the air conditioning system 10 so that all the air reaching the blower consists of return air which is cooled to some extent and thus does not require as much cooling as would the higher temperature of fresh air.

As will be appreciated, various functions can be sensed to determine the precise position of the valve 50 and thereby control the amount of fresh air and return air mixed or whether there will be any mixing at all. Thus, the economizer 34 can be utilized to take advantage of outside air conditions to avoid having to provide unnecessary cooling because of low outside temperatures and, in some instances, to provide relatively less cooling because the outside temperature is high and only return air is recirculated through the system.

Figure 2:
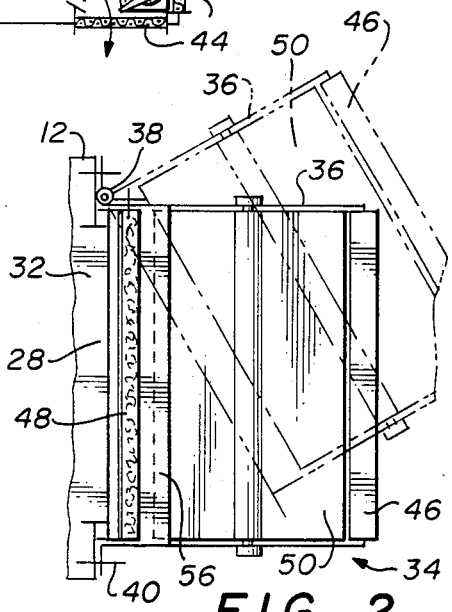
FIG. 2 is a partial, transverse cross-sectional view taken generally along the line 2—2 of FIG. 1.

As mentioned briefly, the housing 36 of the economizer 34 is pivotally supported on the air conditioner by the hinge 38 and can be easily pivoted to the dashed line position shown in FIG. 2 for replacement of the filter 48 or for maintenance as is necessary on the valve controls of the economizer.

From the foregoing, it will be appreciated that the economizer 34 can be manufactured as a part of the thin-line air conditioning system 10 or can be added thereto as an attachment by the simple modifications explained hereinbefore. In either event, the economizer functions to ultimately save energy, provide better air conditioning, and to generally provide a more economical air conditioning system because less energy is utilized.

Having described but a single embodiment of the invention, it will be appreciated that many changes and modifications can be made thereto without departing from the spirit or scope of the invention:

What I claim is:

1. In combination with a thin-line air conditioner having a blower, a compressor, an opening between said blower and compressor for receiving a return air filter and having an access opening adjacent to said blower closed by an access panel, an attachment comprising in combination:

a hollow housing including a return air inlet, an outlet for connection with the air conditioner unit, a fresh air inlet, and an exhaust opening;

impermeable means for closing said first mentioned opening;

means for pivotally connecting said housing to the air conditioner with said outlet adjacent to said access opening in place of the access panel;

control valve means pivotal in said housing from a first position wherein said fresh air inlet is in communication with said outlet to a second position wherein said return air inlet is in communication with said outlet and through an infinite number of intermediate positions wherein fresh air entering said fresh air inlet is mixed with return air before passing through said outlet; and control means for varying the position of said control valve means in response to a preselected signal to obtain only return air, to another signal to obtain only fresh air, and to other signals to obtain a mixture of fresh and return air at the outlet.

2. The attachment of claim 1 and also including sensing means connected with said control means for generating said signals and transmitting said signals to said control means.

3. The attachment of claim 2 wherein said sensing means generates signals related to ambient temperture.

4. The attachment of claim 3 wherein said control means includes:

a motor having a shaft movable in response to said signals; and means connecting said shaft with said control valve means.

5. The attachment of claim 4 and also including a filter removably located in said housing and extending across said outlet.

6. In combination with a thin-line air conditioner having a blower, a compressor, an opening between said blower and compressor for receiving an air filter and having an access opening adjacent to said blower closed by an access panel, an attachment comprising in combination:

a hollow housing including a return air inlet, an outlet for connection with the air conditioner unit, a first edge and a second edge adjacent to said outlet, a fresh air inlet, and an exhaust opening;

a filter removably located in said housing and extending across said outlet;

impermeable means for closing said first mentioned opening;

means for pivotally connecting said housing to the air conditioner with said outlet adjacent to said access opening in place of the access panel, said means including a releaseable fastener connecting said first edge to said air conditioner and pivot means connecting said second edge to said air conditioner;

control valve means pivotal in said housing from a first position wherein said fresh air inlet is in communication with said outlet to a second position wherein said return air inlet is in communication with said outlet and through an infinite number of intermediate positions wherein fresh air entering said fresh air inlet is mixed with return air before passing through said outlet;

control means for varying the position of said control valve means in response to a preselected signal to obtain only return air, to another signal to obtain only fresh air, and to another signal to obtain a mixture of fresh and return air at the outlet, said control means inlcuding a motor having a shaft movable in response to said signals and means for connecting said shaft with said control valve means; and, sensing means connected with said control means for generating said signals and transmitting said signals to said control means and wherein said signals and the position of said valve means are related to ambient temperature.

7. A method for increasing the efficiency of a thin-line air conditioner having a blower, a compressor, a return air filter located in an opening between said blower and compressor and having an access opening adjacent to said blower closed by an access panel, said method comprising the steps of:

removing the access panel;

removing the filter;

closing the opening between the blower and compressor;

pivotally attaching an air control housing to said air conditioner with an outlet in said housing disposed adjacent to the access opening;

sensing the ambient temperature;

transmitting a signal related to said sensed temperature to a control motor; and, positioning a control member to admit only recirculated air to said blower in response to one signal, to admit only fresh air to said blower in response to another signal, and to admit a mixture of recirculated and fresh air in response to still another signal.

* * * * *